US005438928A

United States Patent [19]

Chatwin et al.

[11] Patent Number: 5,438,928

[45] Date of Patent: Aug. 8, 1995

[54] SIGNATURE PANELS

[75] Inventors: Charles E. Chatwin, Horsham, United Kingdom; Karen S. Walker, Maidenhead, Great Britain

[73] Assignee: Thomas de la Rue & Company Limited, London, England

[21] Appl. No.: 266,599

[22] Filed: Jun. 28, 1994

Related U.S. Application Data

[63] Continuation of Ser. No. 934,654, Jan. 7, 1993, abandoned.

[30] Foreign Application Priority Data

Jan. 31, 1990 [GB] United Kingdom ..... 9016821
Jul. 12, 1990 [GB] United Kingdom ..... 9015319

[51] Int. Cl.[6] ..... B41L 47/02
[52] U.S. Cl. ..... 101/369; 156/247
[58] Field of Search ..... 101/369, 401.1, 33, 101/34, 395; 156/230, 247

[56] References Cited

U.S. PATENT DOCUMENTS 1,652,042 12/1927 Neff .
3,034,430 5/1962 Bradford .
3,533,822 10/1970 Bailey .
3,545,380 12/1970 Comegys et al. ..... 101/487
4,836,102 6/1989 Cicci ..... 101/41

FOREIGN PATENT DOCUMENTS 0149542 7/1985 European Pat. Off. .
0476636A1 3/1992 European Pat. Off. .
862360 3/1961 United Kingdom .
1599704 10/1981 United Kingdom .
2128581B 5/1984 United Kingdom .
8300653 3/1983 WIPO .

OTHER PUBLICATIONS

Patent Abstracts of Japan, Abstract for Publication No. 60049993, Jul. 30, 1985.
Derwent Abstract of JP 53074904, 1978.

*Primary Examiner*—Ren Yan
*Attorney, Agent, or Firm*—Oliff & Berridge

[57] ABSTRACT

The invention is to improvements in signature panels for credit cards or similar instruments. The signature panel is made from a foil having a carrier layer with a transferable signature panel layer having a coating composition incorporating a polymeric material. The signature panel layer can be transferred in response to heat and pressure onto a plastic substrate from the carrier layer providing a signature space. A security indicia is placed on or in the signature accepting surface, of the signature panel layer, using an ink to define a rainbow pattern.

14 Claims, 1 Drawing Sheet

SIGNATURE PANELS

This is a continuation of Application No. 07/934,654 filed Jan. 7, 1993, now abandoned.

BACKGROUND OF THE INVENTION

1. Field of the Invention

The invention relates to signature panels commonly found on plastics substrates such as identification and financial cards, methods for forming such signature panels and methods for mounting signature panels on substrates.

2. Discussion of Related Art

Most identification and transaction cards currently issued carry a signature panel for the holder of the card to inscribe his signature. In the case of financial cards such as credit cards, these cards are mass produced in batches and passed to a bureau service which is responsible for imprinting the name and account number of the holder by embossing as well as recording the information on the magnetic stripe. All of the cards then become unique. At this stage they do not possess any biological attributes but when the card is received the holder is required to apply a signature on the signature strip. This signature is commonly the only characteristic of the card which ties the card in biometric terms to the holder.

Clearly the signature panel must be securely affixed to the card to deter fraudulent substitution and it is common for there to be printing on the surface of the panel which will be irreversibly changed if an attempt is made to alter a signature.

In early times signature panels were applied to cards by the screen printing of a suitably pigmented formulation. These panels had relatively low security against fraudulent alteration because of the absence of security printing on their surface.

In 1970 Addressograph-Multigraph, in US-A-3545380, described plastic cards, such as credit cards, having a signature receptive strip with a non-reproducible pattern formed on the surface of the signature strip. Methods of applying such a strip by making a transfer foil which allows the transfer of the printed signature accepting panel under conditions of heat and pressure are also disclosed.

The printing applied to the surface of the signature accepting panel comprises fine linework which the patent states is intended to be difficult to reproduce. The transferrable panels are prepared by printing such linework on the carrier which may be polyethylene terephthalate.

Commercially, cards with such signature panel markings are produced by printing with flexographic inks, that is inks which are set by evaporation. Such cards continue to be available today. The panels however have minimal security.

The level of security protection of such printed panels while enhanced above bare panels is limited. There was a need to provide signature accepting panels of enhanced security. The industry thus developed paper signature panels. Paper panels were able to accommodate enhanced levels of security printing because the substrate was paper rather than a plastic coating. While offering high levels of security the panels are however slow to apply to cards. Lengths of paper strips having repeated security markings are generally laid across large sheets of plastic which are printed with multiples of the card images. These strips would be adhered into place often in a hot laminating press. The large sheets are then cut into individual card blanks.

This is a slow process. Care has to be taken to ensure that the strips are properly bonded to the cards to avoid the possibility of delamination by criminals. The bonding occurs during the card manufacturing process rather than at the end when the card blanks are ready (with any rejects removed).

In 1985 EP-A-149542 addressed the question of security rainbow printing on the surface of credit cards. In passing there was mention as to signature panels incorporating solvent sensitive and/or erasable inks. The patent also mentions the use of rainbow printing on the signature panel in the form of a microprinting design. This again used paper signature panels.

These paper strips have high integral strengths and are well finished. They are usually made chemically reactive against the typical forger's solvents and bleaches.

Although paper strips are advantageous in that they enable a variety of special security printing effects to be achieved by using offset methods including multiple colour printing, their use is labour intensive and their cost is high. They are also more prone to delamination than hot stamped signature strips.

SUMMARY OF THE INVENTION

In accordance with one aspect of the present invention, a transfer foil for providing a signature panel on a substrate comprises a carrier layer supporting a transferable, signature panel layer comprising a coating composition incorporating a polymeric material, wherein the signature panel layer can be transferred in response to heat and pressure onto a substrate from the carrier layer and on a signature accepting surface of which panel layer a signature can be provided, the foil carrying at least one non-fluid based ink placed on or in the signature accepting surface of the panel layer by direct letterpress, offset letterpress, or offset lithographic printing, the printed ink transferring with the transferable layer in use.

In accordance with a second aspect of the present invention, a method of forming a transfer foil to provide a signature panel on a substrate comprises placing at least one non-fluid based ink on a releasable surface of a carrier layer by direct letterpress, offset letterpress, or offset lithographic printing, and providing a transferable, signature panel layer comprising a coating composition incorporating a polymeric material, on the printed carrier layer, the transferable layer and printing being transferable in response to heat and pressure onto a substrate from the carrier layer to provide a signature accepting surface on which a signature can be provided.

We have devised an improved type of transfer foil, in particular a hot stamping foil, suitable for providing signature panels on (plastics) substrates which enables the signature panels to carry high security printing features and which is suitable for high volume manufacture at low cost. This has been achieved by providing a hot stamping foil in combination with at least one non-fluid based ink. In the case of security cards, the hot stamping method allows finished cards to be given their signature panels automatically. The hot stamping is undertaken as the final act of manufacture of card blanks before personalising.

The transferrable layer may exhibit heat bonding characteristics: alternatively the layer may be affixed with heat activatable adhesive present on the transfer foil or locally present on the substrate.

In a preferred example, signature panels are provided on security cards from a foil according to the invention after all information, other than personalised information has been provided on the cards. Thus the use of hot stamping allows signature panels to be applied to otherwise finished cards. In contrast to the batchwise application of paper strips, if a faulty card is detected this can be rejected prior to application of the relatively expensive signature panel and thus avoid wastage and reduce costs.

In the context of this specification, the reference to a "signature" is intended to encompass all types of personal marks which the holder of a card may wish to apply. It is also intended that the signature panel can be provided with a signature by one or more of manual writing in ink, and electronic imaging e.g. by applying signature replicas using ink jet printing, dye diffusion imaging laser, printing with toner deposition, and ion deposition printing.

The polymeric material will typically comprise a binder for binding pigment particles which the layer will normally contain.

In some cases, an adhesive could be selectively laid down on the substrate following which the transfer foil is urged into engagement with the substrate under conditions of elevated temperature and pressure the carrier layer subsequently being stripped away, portions of the transferable layer remaining in contact with those parts of the substrate carrying adhesive while the remaining parts of the polymeric transferable layer stay attached to the carrier layer. Engagement may be achieved by stamping or rolling means.

Preferably, however, the foil further comprises a thermally activatable adhesive coating on the exposed surface of the transferable layer. In this form, the foil constitutes a hot blockable foil, transfer of the polymeric transferable layer being achieved by applying a hot mandrel or the like onto the carrier layer above those portions of the polymeric transferable layer which are to be transferred. The adhesive coating will activate during the hot stamping process but set at ambient temperatures. The weak transferred layer is readily integrally transferred from the releasable carrier film.

In most cases, the foil will include a release coating between the carrier layer and the polymeric transferable layer, for example wax. However, other arrangements are possible and for example the carrier layer could be provided with a releasable lacquer coating as is described in more detail in GB-A-2069409, or the carrier layer could undergo a corona treatment to allow control of release properties. Such surface energy enhancement treatment by corona allows highly releasing materials such as polyethylene to be used as carriers.

The printing step occurs prior to provision of the transferable layer. In particular, where a release layer is provided, the method comprises printing the ink onto the release layer. Clearly, the ink must have a clinging engagement to the release layer sufficient for it to be printed but must be able to adhere strongly to the polymeric transferable layer so that it can be stripped from the release layer in use.

It is important to distinguish non-fluid based inks i.e. "paste" inks from "fluid" inks, the former having a much higher solids content and essentially no evaporable content. Thus in paste inks the content of evaporable solvents will generally be less than 5% and will probably be less than 2%. In fluid inks the evaporable content is generally greater than 80% and may be greater than 90%.

Security printing methods such as wet and dry offset lithography and direct and indirect letterpress, and corresponding security inks have not hitherto been applied to heat transferrable signature panel compositions.

The paste inks which are employed may be coloured (including black or white), metallic, coloured metallic, luminescent including fluorescent or phosphorescent, and responsive to radiation including ultraviolet and infrared, optically varying such as by including particles of thin layer dielectric composites, irridescent, pearlescent, opalescent, opaque or transparent, photochromic, solvatochromic or the like.

It is possible to employ ultraviolet radiation or electron beam curable inks, the curing occuring preferably before the application of the signature panel coating. In addition, invisible, ultraviolet responsive fluorescent inks could be included.

The inks may contain solvent sensitive, fugitive dyes. In this case the signature panel coating should preferably be applied from an aqueous coating dispersion rather than solvent.

The paste inks may be printed in the form of images e.g. of characters, shapes, logos or designs, or may be applied to give an overall background tinting effect.

Generally the background printing on signature strips is faint so that the signature made in darker ink is readily discernable. The polymeric layer may include a bleach revealing agents that a colour change can occur if an attempt is made to bleach a signature.

The transferable signature layer typically comprises clay, calcium carbonate, titanium dioxide or other white or light coloured pigment contained in a binder such as polyacrylate, polystyrene, polyurethane, styrene-butadiene rubber, polyvinyl chloride or polyvinyl acetate or copolymers. A typical dry formulation will have 80% by weight of pigment and 20% of binder. Preferably, the signature panel layer is a non-solvent soluble coating.

In one important application of the invention, inks are placed on the foil using a rainbow printing technique. This is important since it then becomes possible to achieve the rainbow effect across the width of an elongate foil so that when panels are laid down on the substrate by continuous stamping from reel stock the variation in colour will occur along the length of the panel. This should be contrasted with colour variations which are achievable using paper signature panels. If paper for forming signature panels is held on reel it is not possible to achieve a rainbow effect running across the card ie. across the signature direction.

Our preferred printing method is dry offset letterpress printing in which raised image portions are inked and these image portions are transferred to an offsetting blanket which transfers the ink to the final substrate (the carrier). In wet offset lithography the ink is delivered image wise to a planographic surface before being transferred by an offsetting blanket to the final substrate (the carrier). The planographic surface may possess hydrophilic surfaces as in wet lithography or abherent surfaces as in dry lithography. In direct letterpress printing shaped characters are inked and these are directly applied to the substrate without offsetting onto an intermediate cylinder.

The invention has a number of significant advantages. It enables for the first time the wide variety of offset security printing methods to be brought to hot stamp signature panel continuous manufacturing methods. It enables the security benefits of rainbow effects to be achieved across a signature panel in mass production. It enables the potential use of ultraviolet curable ink to give production benefits in reducing the "setoff" of freshly printed ink against the back of the next printed surface on the reel, counterfeit and forgery protection, enabling the use of solvent sensitive inks with the polymeric layer or coating being applied from aqueous dispersion. Finally, it allows more automated manufacturing and process control to be achieved enabling high volume production.

In the preferred example, where the panel carries a rainbow pattern of security indicia comprising fugitive inks and the signature panel comprises a bleach revealing agent, the panel will enhance security of a substrate to which it is affixed by:

a) inhibiting removal as hot blocked strips are thinner than paper strips and less likely to be delaminable intact;
b) providing anticounterfeit (ie. new manufacture) and anti-forgery properties as the images will be rainbow printed; and
c) providing further antiforgery properties as
   i) one or more inks will have fugitive properties (i.e. a stain will spread readily when the ink is contacted with a wide variety of solvents);
   ii) the clay ink receptive coating will also possess bleach-indicating reagents.

Thus in the preferred case, batches of otherwise complete cards will be cut to size before passing into a hot stamping machine. The stamping head of the machine will then undertake continuous step and repeat action to apply signature panels provided on a reel. The carrier will step forward by at least one panel unit each time to present a new panel area. The reel of signature panel material will generally have a "wallpaper" security printed design so that longitudinal registration between individual images which are repeated regularly on the signature accepting surface of the transfer foil and the card is not necessary. The images will be provided on the diagonal. This is sometimes employed because the eye will pick up variations in longitudinal register more readily than diagonal variations. The line spacing between the images will be regular. Any one line of text will comprise one or more regularly repeated images eg. words. The line spacing will be greater than the height of individual images. If necessary evenly intersecting patterns of alternate lines printed in different inks may be used. Thus for example every second line will be printed at a first printing station; the intervening lines will be printed at the next station. Once complete the reels can be slit: the rainbow bands will run longitudinally, the colour changes being across the width of the reel. Stamping will be done so that the card has the colour changes running in the reading direction.

The series of panels after application to the substrate, such as PVC card, can be imaged by any individualising means either manually or automatically as explained above.

BRIEF DESCRIPTION OF THE DRAWINGS

An example of a foil and a method for applying the foil to a card will now be described with reference to the accompanying drawings in which:

FIG. 1 illustrates in cross section an example of a hot blockable signature foil. The foil comprises a carrier layer 20 which will typically be a biaxially orientated polyester film. A release layer 21 such as a wax coating is provided on the carrier layer 20. Subsequently, a paste ink preferably including an invisible fluorescing agent is printed onto the release layer 21 using a letterpress offset or lithographic offset technique. As has been mentioned above, the image constituting the security pattern may be printed in a variety of ways, for example in the form of indicia with ink providing, a flat tint of low density, or particularly preferably in rainbow form across the width of the foil. The apparatus for printing the ink can have any conventional form, the ink being any ink used in the commercial or security printing industries for letterpress or lithographic offset printing. Similarly intervening alternate lines 4B are printed in different inks.

Following printing, a signature panel coating 22 is provided on the release layer 21, the coating 22 comprising clay or calcium carbonate or other white pigment contained in a binder such as polyacrylate, polystyrene, polyurethane, styrene-butadiene rubber, polyvinyl chloride or polyvinyl acetate. Finally, a thermally activatable adhesive coating 23 is provided on the coating 22.

Figure 1:
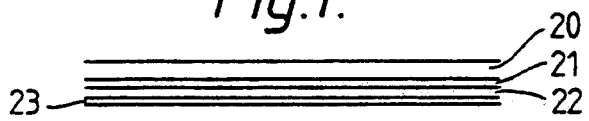
FIG. 1 is a cross-section through a foil.
Figure 2:
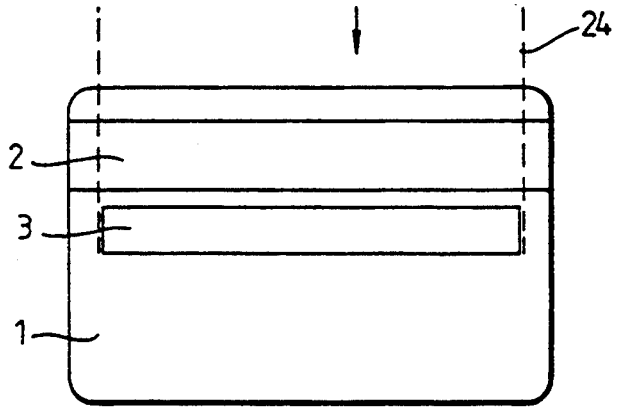
FIG. 2 illustrates a financial card such as a credit card carrying a signature panel.

FIG. 2 illustrates a prelaminated PVC card blank 1 which already carries a magnetic strip 2 and all other non-personalised information (not shown). A signature panel is to be formed in the region 3. This is achieved by feeding the foil described in FIG. 1 from a reel over the card blank 1 as shown at 24 in FIG. 2.

Figure 4:
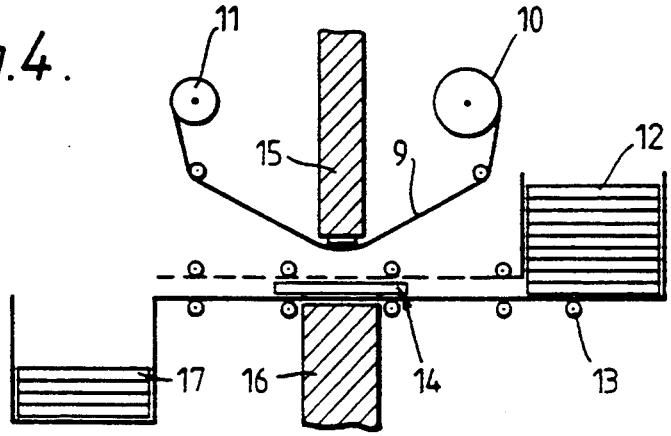
FIG. 4 illustrates diagrammatically an apparatus for applying the signature panel to the card.

Apparatus for transferring the signature from the foil onto the card is shown in FIG. 4. The apparatus comprises a foil delivery spool 10 from which the foil 9 is drawn around a hot mandrel 15 to a used tape windup spool 11. Card blanks of the form shown in FIG. 2 are stored in a pile 12 and are fed in sequence by transport rollers 13 to a transfer station 14 where each card is held upon a pressure platen 16. At this point, the mandrel 15 is lowered to bring the foil 9 into contact with the card in the transfer station 14 causing the adhesive layer 23 under the mandrel 15 to be activated. The mandrel 15 is then withdrawn and the windup spool 11 rotated causing the carrier layer 20 to be stripped away from the signature panel coating 22 which remains adhered to the card in the printing station. Furthermore, the ink which had been offset printed onto the release layer during construction of the tape will transfer with the signature panel coating 22. Following transfer, the transport rollers 13 are reactivated and the finished card fed to a pile 17.

Figure 3:
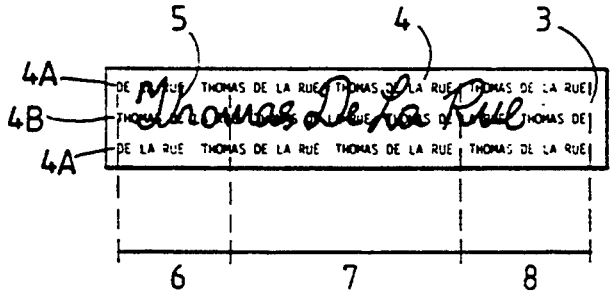
FIG. 3 illustrates the signature panel of FIG. 2 in more detail.

The appearance of the signature panel after transfer is indicated schematically in FIG. 3. The panel 3 carries a repeated imprint 4 of the issuer's name produced by offset printing and also rainbow printing (not visible in the drawing) extending along the length of the signature panel (i.e. across the width of the original foil). Thus, for example, alternative lines of text 4A printed with a first rainbow blend the rainbow colours may comprise a first colour in a region 6, a second colour in a region 8, and a blend between the first and second colours in an intermediate region 7. Similar rainbow blending may be used for lines 4B.

The finished card is then supplied to the card holder who inscribes his signature 5 in the signature panel.

Signature panels are generally rectangular in shape but it is possible to create a less regular shape by providing edge variation such as of a wave or triangular form while still leaving clear a signature area. Such changes in shape can readily be obtained using a different design of mandrel.

Prior to application of the adhesive layer to the panel and while on the carrier the panel layer and carrier may be mildly embossed with a patterned steel roller.

EXAMPLE

A release coated biaxially orientated polyester film of thickness 23 microns and of the type used for metallic and holographic blocking foils was placed in reel form in a dry offset security printing press. The thin release (i.e. wax) surface was printed with a regularly repeated design such that a signature panel would exhibit multiples of the design. The design was printed with regular periodicity along the whole length of the reel.

The design (e.g. of text) was printed with a curable coloured ink which was cured by ultraviolet radiation. The curable ink optionally may contain a dye which is soluble in a wide range of common organic solvents. Such a fugitive ink provides a deterrent against those who wish to forge new signatures by erasing earlier signatures with common organic solvent. Alternatively, or additionally, the curable ink may include a luminescent pigment or dye such as an ultraviolet responsive visible light fluorescing pigment or dye.

In an alternative embodiment the release film was printed with an image of the above style but using blue and yellow "rainbow" blended inks. One of these inks may have an ultraviolet radiation responsive visible light fluorescing or phosphorescing agent. At least one of these inks may include a dye which will cause staining when exposed to common organic solvents, i.e. the ink will be fugitive and thus have anti-forgery properties.

In an alternative embodiment two sets of images each comprising identically spaced regular designs endlessly repeated, with the two sets presented half a repeat unit apart, may be used. The first set may be printed with a first ink or ink set and the second set with a different set of inks.

The pigmented polymeric signature panel coating was then applied at a thickness of approximately 15 microns. This coating will generally have a dry thickness of between 10 and 50 microns. The coating comprised a titanium dioxide pigment (if necessary blended with another pigment) dispersed in an aqueous emulsion of a polyvinyl polymer such as vinyl acetate-acrylic copolymer. The pigment to binder ratio was such that the coating did not flake or powder when dry and was suitable for signature acceptance, the pigment powder content typically being 50 to 70% of the dry weight.

Into this coating at a level of up to one percent into the wet formulation of approximately 50% solids content was optionally included a bleaching solution indicating agent, diphenyl guanidine.

If a sufficient proportion of vinyl polymer is incorporated into the signature accepting layer, the dried coating may itself exhibit heat activatable adhesion to the substrate when applied under conventional stamping pressures at a temperature within the typical range of 80 to 120 degrees Centigrade.

More commonly, a heat activatable adhesive of the type used for hot blocking foils will then be coated out the pigmented polymeric layer from solvent, care being taken that the coating solvent does not activate any fugitive dye. The heat activatable adhesives when dry will become adhesive generally within the hot stamping temperature range of 80 to 120 degrees Centigrade. Its dry thickness will generally be 1 to 2 microns.

After drying of the adhesive the transfer foil is then ready for use. Signature panel areas may then be applied to the surface of PVC cards by hot stamping means (e.g. 100 degrees C. at 20 kN for 1 second).

The resulting card has a signature accepting panel cost effectively applied, the signature panel possessing a high degree of resistance to counterfeiting, forgery, substitution and other forms of tampering.

We claim:

1. A transfer foil for providing a signature panel on a substrate, the foil comprising:

a carrier layer; and a transferable signature panel layer having a signature accepting surface facing said carrier layer comprising a coating composition incorporating a polymeric material supported on the carrier layer, wherein the signature panel layer can be transferred in response to heat and pressure onto a substrate from the carrier layer and on the signature accepting surface of which signature panel layer a signature can be provided, the foil carrying at least one ink, chosen from the group consisting of paste inks, ultraviolet radiation curable inks and electron beam curable inks, placed on or in the signature accepting surface of the signature panel layer by direct letterpress, offset letterpress, or offset lithographic printing, the printed ink transferring with the transferable layer in use.

2. A foil according to claim 1, wherein the transferable signature panel layer is a substantially evaporable solvent-free coating.

3. A foil according to claim 2, wherein the substantially evaporable solvent-free coating comprises a pigment as the polymeric material and a binder.

4. A foil according to claim 1, wherein the transferable signature panel layer is selected from the group consisting of clay, calcium carbonate, titanium dioxide, and other white coloured pigment or light coloured pigment contained in a binder, wherein that binder is polyacrylate, polystyrene, polyurethane, styrene-butadiene rubber, polyvinyl chloride, polyvinyl acetate or polyvinyl copolymers.

5. A foil according to claim 1, wherein the transferable layer includes a bleach revealing agent.

6. A foil according to claim 1, wherein the ink includes a solvent sensitive agent.

7. A foil according to claim 1, further comprising a thermally activatable adhesive coating on the transferable layer.

8. A foil according to claim 1, further comprising a release layer between the carrier layer and the transferable layer.

9. A foil according to claim 1, wherein at least two inks chosen from the group have been placed thereon to form a rainbow pattern.

10. An elongate foil according to claim 9, wherein the variation in colour across the rainbow pattern occurs transverse to the longitudinal direction of the foil.

11. A foil according to claim 1, wherein said at least one ink is selected from inks in a group consisting of coloured, metallic, coloured metallic, luminescent including fluorescent or phosphorescent and responsive to radiation including ultraviolet and infrared, optically varying iridescent, pearlescent, opalescent, opaque or transparent, photochromic and solvatochromic.

12. A foil according to claim 1, wherein said at least one ink comprises an ultraviolet radiation or electron beam curable ink.

13. A transfer foil according to claim 1, the foil comprising an elongate strip from which a plurality of signature panels can be formed.

14. A transfer foil according to claim 1, wherein there are at least two inks disposed on the signature accepting surface in a rainbow pattern.

* * * * *